US006421519B1

(12) United States Patent
Yamashita et al.

(10) Patent No.: US 6,421,519 B1
(45) Date of Patent: Jul. 16, 2002

(54) MAGNET ROLL HAVING AN ANISOTROPIC BONDED MAGNET PORTION CONTAINING RARE EARTH-IRON-NITROGEN MAGNET POWDER

(75) Inventors: Keitaro Yamashita; Masahiro Tobise, both of Saitama-ken (JP)

(73) Assignees: Hitachi Metals Ltd., Tokyo; Hitachi Metals Kiko, Ltd., Gunma-ken, both of (JP)

( * ) Notice: Subject to any disclaimer, the term of this patent is extended or adjusted under 35 U.S.C. 154(b) by 0 days.

(21) Appl. No.: 09/725,904

(22) Filed: Nov. 30, 2000

(30) Foreign Application Priority Data

Nov. 30, 2000 (JP) ..... 2000-084304

(51) Int. Cl.[7] ..... G03G 15/09; G03G 15/00; H01F 3/00; H01F 7/02

(52) U.S. Cl. ..... 399/277; 335/296; 335/306

(58) Field of Search ..... 399/277, 279; 335/296, 302, 306

(56) References Cited

U.S. PATENT DOCUMENTS 4,557,582 A * 12/1985 Kan et al. ..... 399/277
4,678,634 A * 7/1987 Tawara et al. ..... 335/302 X
5,359,397 A * 10/1994 Yamaji ..... 399/277
5,425,818 A * 6/1995 Hirosawa et al. ..... 148/101 X
5,705,970 A * 1/1998 Nishida et al. ..... 335/306 X
5,888,416 A * 3/1999 Ikuma et al. ..... 335/302 X
6,021,296 A * 2/2000 Tamura et al. ..... 399/277

FOREIGN PATENT DOCUMENTS

| | | |
|---|---|---|
| JP | 3-160705 | 7/1991 |
| JP | 4-260302 | 9/1992 |
| JP | 08-031626 | 2/1996 |
| JP | 2000-021615 | 1/2000 |
| JP | 2000-082611 | 3/2000 |

OTHER PUBLICATIONS

Masahiro Tobise, "Sm–(Fe, Ti B)–N type bonded magnets excellent in heat resistance and wear resistance," Industrial Material, vol. 46 (No. 12), pp. 49–52 (1998).

* cited by examiner

*Primary Examiner*—Fred L Braun
(74) *Attorney, Agent, or Firm*—Morgan, Lewis & Bockius LLP

(57) ABSTRACT

A magnet roll has a plurality of magnetic poles on a surface with at least one magnetic pole portion being composed of an anisotropic bonded magnet including magnet powder and binder resin. The anisotropic bonded magnet contains R—T—N magnet powder, wherein R is at least one rare earth element including Y, Sm being indispensable, and T is Fe or Fe and Co. The R—T—N magnet powder may also contain inevitable impurities such as C, O and H. The binder resin constitutes 20–70% of the volume of the anisotropic bonded magnet such that the anisotropic bonded magnet have a maximum energy product $(BH)_{max}$ of 10 MGOe or more and a residual magnetization Br of 2800 G or more.

6 Claims, 6 Drawing Sheets

MAGNET ROLL HAVING AN ANISOTROPIC BONDED MAGNET PORTION CONTAINING RARE EARTH-IRON-NITROGEN MAGNET POWDER

FIELD OF THE INVENTION

The present invention relates to a magnet roll used as a developing roll in electrophotography, electrostatic recording, etc.

PRIOR ART

In electrophotograph, electrostatic recording, etc., electrostatic image is formed on a surface of an image-bearing member (photo-sensitive body or dielectric body), and developed with a magnetic developer containing toner (one-component magnetic toner or two-component developer comprising toner and a magnetic carrier) conveyed to a developing region by a developing roll, and the resultant toner image is transferred to a transfer member (plain paper or the like) and fixed thereto is by heating and/or pressing.

Widely used as a developing roll is, for example, a magnet roll assembly having a structure as shown in FIG. 4. Referring to FIG. 4, a magnet roll 1 comprises a cylindrical permanent magnet 11 having a plurality of magnetic poles extending on its surface along a longitudinal direction and a shaft 12 fixed concentrically to a center portion of the cylindrical permanent magnet 11. As shown in FIG. 3, the magnet roll 1 is enclosed in a cylindrical sleeve 2 and supported by flanges 3*a*, 3*b* via bearings 4*a*, 4*b* at both ends of the shaft 12. The sleeve 2 and the flanges 3*a*, 3*b* fixed to both ends thereof are made of non-magnetic materials such as aluminum alloys, austenitic stainless steel, etc. A numeral 5 denotes a seal member (oil seal). With the above structure, a magnetic developer is attracted onto a surface of the sleeve 2 and conveyed to a developing region (region in which the image-bearing member is positioned in opposite to the sleeve) by a relative rotation of the magnet roll 1 and the sleeve 2 (for instance, by rotating the flange 3*a* while keeping the magnet roll 1 stationary) to develop the electrostatic image.

The cylindrical permanent magnet constituting the above magnet roll is usually an elongated one having an outer diameter D of 10–60 mm and a length L of 200–300 mm, $L/D \geqq 5$, and formed of an isotropic sintered ferrite magnet, or an anisotropic bonded magnet mainly composed of ferromagnetic particles (Sr ferrite or Ba ferrite) and a resin (polyamides, chlorinated polyethylene, etc.). The anisotropic bonded magnet is produced, for instance, by heat-blending a mixture of starting materials, extrusion-molding or injection-molding the molten blend in a magnetic field and then magnetizing the molded product according to a magnetization pattern.

Toner and carrier are made finer to satisfy the recent demand of higher image quality, and the magnet roll tends to increase its magnetic force to compensate for a decrease in attraction thereof to the magnet roll. The magnetic force required for the magnet roll is about 500–800 G on a sleeve surface, suitable for almost all developing processes. However, there have been provided a developing process requiring as high a magnetic force as about 1000–1300 G.

The isotropic sintered ferrite magnets can be provided with any magnetic force distribution by integral magnetization, so that they are materials good in stability and extremely easy to use. However, they are disadvantageous in that their residual magnetic flux density Br is about 2000 G. resulting in a magnetic flux density limited to about 900–1000 G on a sleeve surface, failing to meet the demand of higher magnetic field.

On the other hand, the anisotropic bonded magnets can easily be provided with a residual magnetic flux density Br of about 2600 G, for instance, generating a magnetic field stronger than that of the isotropic sintered ferrite magnets. However, magnetic poles can be formed only in predetermined directions (anisotropic directions), limiting a magnetic force distribution. Further, orientation should be carried out in a magnetic field during molding, resulting in an anisotropic bonded magnet suffering from unevenness in magnetic properties in a longitudinal direction and poor productivity.

Moreover, the sintered ferrite magnets are hard ceramics, which are brittle materials poor in impact resistance and difficult to be worked, so that working relies on grinding in most cases. On the other hand, the bonded magnets can overcome such disadvantages of the sintered ferrite magnets. However, because they are anisotropic magnets oriented in a magnetic field, they are provided with magnetic poles only in fixed directions even in a cylindrical shape. As a result, they do not have the degree of freedom that any desired arrangement of magnetic poles are formed by magnetization, unlike the isotropic sintered ferrite magnets. In addition, because the anisotropic bonded magnets are long in size, uniform magnetic field orientation is difficult, and their variation in the longitudinal direction of the magnet roll also increases several times that of the isotropic sintered ferrite magnets, which raises the problem that image quality is greatly influenced in a magnetic brush development system sensitive to the uniformity of magnetic force.

Also, because the temperature coefficient of Br is as high as 0.2 %/° C. in the sintered ferrite magnets, developing conditions may vary depending on the environment of use in high-image quality digital apparatuses having extremely high sensitivity in development, resulting in changes in developed images in some cases.

As described above, isotropic magnet materials having high magnetic properties have been desired as the solution to the problems (poor surface magnetic flux density, large variations in surface magnetic flux density, lack of the flexibility of magnetic pole formation, temperature changes in surface magnetic flux density, etc.) of the conventional magnet materials.

As magnets for meeting such a demand, isotropic bonded magnets comprising Nd—Fe—B magnet powder, which have $(BH)_{max}$ of about 3 MGOe, have been proposed. However, the Nd—Fe—B bonded magnets have a problem with regard to corrosion resistance, and are vulnerable to rusting, so that they should be coated with epoxy resins, fluororesins, etc. Long articles such as magnet rolls are likely to have coatings with defects, resulting in an increase in product cost. Also, in the case of magnet rolls, gaps between magnets and inner diameters of sleeves are generally set as small as about 0.5–1 mm to utilize surface magnetic flux densities of the magnets on the sleeves as efficiently as possible. Thus, if rust is generated on the magnets, the gaps between the magnets and the sleeves are clogged with rust, resulting in higher risk of locking accident.

Also, in long articles such as cylindrical permanent magnets for magnet rolls produced by extrusion molding, etc., magnet powder should be dispersed uniformly in the cylindrical permanent magnets to obtain uniform properties along the longitudinal direction, and magnet powder having a spherical shape is advantageous in uniform dispersion. Ferrite magnet powder is suitable for uniform dispersion because it has a particle size of about 1 μm. However, Nd—Fe—B magnet powder is in a shape of thin flake, so that it is difficult to be dispersed uniformly. If the Nd—Fe—B magnet powder is pulverized to 100 μm or less to achieve more uniform dispersion, it suffers from drastic deterioration of magnetic properties. Accordingly, although the bonded ferrite magnets are excellent in molding properties, they are low in surface magnetic flux densities and also poor in temperature stability. The Nd—Fe—B bonded magnets are high in surface magnetic flux densities, but have a problem in respect to molding properties. They are also low in corrosion resistance and temperature stability. As described above, both magnets have many problems to be solved for applying them to the magnet rolls.

In view of such circumstances, a magnet roll comprising a cylindrical permanent magnet concurrently satisfying demands for surface magnetic flux density, temperature stability, corrosion resistance and molding properties have been desired.

OBJECT OF THE INVENTION

It is therefore an object of the present invention to solve the problems of the conventional art, thereby providing an easy-to-use magnet roll having a high and uniform surface magnetic flux density.

DISCLOSURE OF THE INVENTION

The first magnet roll of the present invention has a plurality of magnetic poles on a surface, at least one magnetic pole portion comprising an anisotropic bonded magnet containing magnet powder and a binder resin, the anisotropic bonded magnet containing an R—T—N magnet powder, wherein R is at least one rare earth element including Y, Sm being indispensable, T is Fe or Fe and Co, and O and H, inevitable impurities, may be contained, and the binder resin, a volume ratio of the binder resin being 20–70%. With this constitution, the R—T—N magnet powder has substantially the same saturation magnetization as that of the Nd—Fe—B magnet powder, so that the magnet roll has a high surface magnetic flux density. Further, the corrosion resistance can be improved drastically by reducing the C content of the R—T—N magnet powder to a trace amount.

The bonded magnet of the present invention can have $(BH)_{max}$ of 10 MGOe or more, and Br of 2800 G or more with the amount of the binder resin adjusted.

The R—T—N magnet powder has a temperature coefficient of a residual magnetic flux density Br of −0.065%/° C., much smaller than a temperature coefficient of Br of −0.12%/° C. of Nd—Fe—B magnet powder and a temperature coefficient of Br of 0.2%/° C. of a sintered Sr ferrite magnet. Accordingly, even when the magnet roll comprising a bonded magnet containing the R—T—N magnet powder is used under severe conditions such as high temperature, continuous printing, etc. to elevate the temperature of the bonded magnet, the surface magnetic flux density of the magnet roll appearing on a sleeve surface varies only slightly, thereby stably providing high-quality image.

No rust is generated even when the above-described nitride magnet powder is exposed to a surface of the bonded magnet. Accordingly, even when the magnet roll is used in a high-temperature, high-humidity environment, there is no likelihood of locking, ensuring high reliability. Further, the average particle size of the R—T—N magnet powder can be appropriately adjusted between 1 μm and 10 μm. Therefore, even when the ratio of the binder resin is changed for obtaining a required surface magnetic flux density, excellent moldability can be realized by changing the size of the R—T—N magnet powder, thereby allowing the required surface magnetic flux density and excellent moldability to be compatible with each other.

The above-described R—T—N magnet powder is preferably (a) a rare-earth magnet containing main ingredients having a composition represented by $R_\alpha T_{100-(\alpha+\delta)}N_\delta$ by atomic %, wherein R is at least one rare earth element including Y, Sm being indispensable, T is Fe or Fe and Co, and α and δ satisfy $5 \leqq \alpha \leqq 18$ and $4 \leqq \delta \leqq 30$, respectively; O and H, inevitable impurities; and C in an amount of 5 atomic % or less based on the magnet powder, and having a magnetism-generating phase which is substantially a hard magnetic phase composed of a rhombohedral crystal having a $Th_2Zn_{17}$ structure and/or a hexagonal crystal having a $Th_2Ni_7$ structure, or (b) a rare-earth magnet containing main ingredients having a composition represented by $R_\alpha T_{100-(\alpha+\beta+\delta)}M_\beta N_\delta$ by atomic %, wherein R is at least one rare earth element including Y, Sm being indispensable, T is Fe or Fe and Co, M is at least one element selected from the group consisting of Al, Ti, V, Cr, Mn, Cu, Ga, Zr, Nb, Mo, Hf, Ta and W, Ti being indispensable, and α, β and δ satisfy $5 \leqq \alpha \leqq 18$, $1 \leqq \beta \leqq 30$ and $4 \leqq \delta \leqq 30$, respectively; O and H, inevitable impurities; and C in an amount of 5 atomic % or less based on the magnet powder, and having a magnetism-generating phase which is substantially a hard magnetic phase composed of a rhombohedral crystal having a $Th_2Zn_{17}$ structure and/or a hexagonal crystal having a $Th_2Ni_{17}$ structure.

R should include Sm an indispensable element and may further include one or more of Y, La, Ce, Pr, Nd, Eu, Gd, Tb, Dy, Ho, Er, Tm, Yb and Lu. Mixtures of two or more rare earth elements such as Sm misch metals or didymium may also be used. A combination of Sm and one or more of Y, Ce, Pr, Nd, Gd, Dy and Er is preferable as R, and a combination of Sm and one or more of Y, Ce, Pr and Nd is more preferable. Particularly preferable is Sm substantially alone. With respect to the content of Sm, the percentage of Sm in R is preferably 50 atomic % or more, and more preferably 70 atomic % or more, to obtain a high surface magnetic flux density. R may contain inevitable impurities such as O, H, Al, Si, Na, Mg, Ca, etc., whose inclusion is unavoidable in production processes, as long as the properties are not deteriorated.

The content of R is preferably 5–18 atomic %. When R is less than 5 atomic % or more than 18 atomic %, αFe is generated in a large amount, and other phases than a hard magnetic phase are generated, resulting in a decrease in surface magnetic flux density. The more preferable content of R is 6–12 atomic %.

Though the addition of a suitable amount of the M element slightly reduces the surface magnetic flux density, the bonded magnet is provided with extremely improved heat resistance, thereby providing a high-performance magnet roll suitable for continuous printing at high temperatures. The content of the M element is preferably 1–30 atomic %. When the M element exceeds 30 atomic %, an $Sm(Fe, M)_{12}N_z$ phase of a $ThMn_{12}$ type is generated, resulting in decrease in surface magnetic flux density. On the other hand, when the M element is less than 1 atomic %, αFe is generated, likewise resulting in decrease in surface magnetic flux density.

The content (γ) of C is preferably 5 atomic % or less based on the magnet powder. More than 5 atomic % of C decreases a surface magnetic flux density and deteriorates corrosion resistance.

The content (δ) of nitrogen is preferably 4–30 atomic %. When the content of nitrogen is less than 4 atomic % or more than 30 atomic %, the surface magnetic flux density is low. The more preferable content of nitrogen is 10–20 atomic %.

In the above-described rare earth nitride magnet, 0.01–30 atomic % of Fe may be substituted by Co and/or Ni. The introduction of Co and/or Ni improves the temperature characteristics of the bonded magnet. However, when the amount of Co and/or Ni exceeds 30 atomic %, the surface magnetic flux density of the bonded magnet is significantly decreased. On the other hand, it is less than 0.01 atomic %, the addition effect thereof is not observed. The amount of Co and/or Ni substituted for Fe is more preferably within the range of 1–20 atomic %.

The pressure of a pure nitrogen gas or a nitrogen-containing gas in a nitriding treatment is preferably about 0.2–10 atm. The nitriding reaction is slow at lower than 0.2 atm, while the pressure of more than 10 atm necessitates a more expensive high-pressure gas apparatus. The more preferable pressure range of the nitriding gas is 1–10 atm. The heating conditions for the gas nitriding are preferably 300–650° C.×0.1–30 hours. Less than 300° C.×0.1 hour results in low nitrization, while more than 650° C.×30 hours causes the generation of the R—N phase and the Fe—M phase, resulting in a significant decrease in surface magnetic flux density. The heating conditions for the gas nitriding is more preferably 400–550° C.×0.5–30 hours, and particularly preferably 400–550° C.×1–10 hours.

For realizing the uniform nitriding treatment and securing the easy molding of the bonded magnet, it is preferable that pulverization and classification are optionally carried out before nitriding to adjust a particle size of the magnet powder.

A magnet roll produced from a mixture of the above-described nitride-type rare earth (R—T—N) magnet powder with ferrite magnet powder can not only be lower at cost than that produced from nitride-type rare earth magnet powder alone, but also higher in a surface magnetic flux density than a bonded magnet composed only of ferrite magnet powder.

The second magnet roll has a plurality of magnetic poles on a surface, at least one magnetic pole portion being composed of an anisotropic bonded magnet obtained by molding a mixture comprising nitride-type rare earth magnet powder of an R—T—N alloy, wherein R is at least one rare earth element including Y, Sm being indispensable, T is Fe or Fe and Co, and O and H, inevitable impurities, may be contained, ferrite magnet powder and a binder resin in a magnetic field, a volume ratio of the binder resin being 20–70%.

As the ferrite magnet powder used in the present invention, ferrite powder having a main ingredient composition represented by $A'O.nFe_2O_3$ (atomic ratio), wherein A is Sr and/or Ba, and n (molar ratio)=5–6, is highly useful.

The ferrite magnet powder for the anisotropic bonded magnets suitable for the present invention can be produced, for example, by processes of mixing of starting material powder→ferritization by calcination (solid-phase reaction) →pulverization→heat treatment → disintegration (sieving) treatment. The average particle size of the ferrite magnet powder is preferably 0.8–2 μm, more preferably 0.9–1.5 μm. When the average particle size is outside this range, it is difficult to prepare a useful magnet roll.

The isotropic ferrite magnet powder can be produced by processes of mixing of starting material powder→ferritization by calcination (solid-phase reaction) →pulverization→heat treatment→disintegration (sieving) treatment.

BRIEF DESCRIPTION OF THE DRAWINGS

FIG. 3(*b*) is a cross-sectional view taken along the line B—B in FIG. 3(*a*);

DESCRIPTION OF PREFERRED EMBODIMENTS OF THE INVENTION

The bonded magnet of the present invention is produced by the following method. First, the magnet powder and the thermoplastic resin are dry-mixed, for example, with a mixer. The resultant mixture is heat-kneaded, and then pulverized to several millimeters or less, followed by granulation. The kneading and granulation can be carried out, for example, in a double-screw kneading extruder at a temperature of 100–200° C.

As the magnet powder, the above-described R—T—N magnet powder can be used, and particles having an average particle size of 1–10 μm are preferably used from the aspect of magnetic properties, moldability; and productivity. To improve the wettability of the magnet powder to a binder resin, the magnet powder may be surface-treated with organic silicon compounds (silane coupling agents) or organic titanate compounds (titanium coupling agents), for instance. The binder resins include polyamide resins, chlorinated polyethylene, ethylene-ethyl acrylate copolymers (EEA), etc.

In addition to the above-described essential ingredients, dispersants, lubricants, plasticizers, etc. can be added to the starting materials. The total amount of these additives is preferably 3 weight % or less, more preferably 1–2 weight %. Usable as the dispersants are phenols, amines, etc. Usable as the lubricants are waxes such as paraffin wax, microcrystalline wax, etc., fatty acids such as stearic acid, oleic acid, etc., fatty acid salts such as calcium stearate, zinc stearate, etc. Usable as the plasticizers are, for instance, phthalates such as di-2-ethylhexyl phthalate (DOP), dibutyl phthalate (DBP), etc.

The above-described starting material mixture is charged into a molding apparatus, and extruded through a molding die attached to a tip end thereof to form an anisotropic cylindrical molded product, which is cooled, demagnetized and then cut to a desired length. After fixing a shaft to a center bore of the resultant cylindrical molded product, it is magnetized to have a plurality of (usually 3–8) magnetic poles on a surface thereof to provide a magnet roll 1 shown in FIG. 3.

Figure 1:
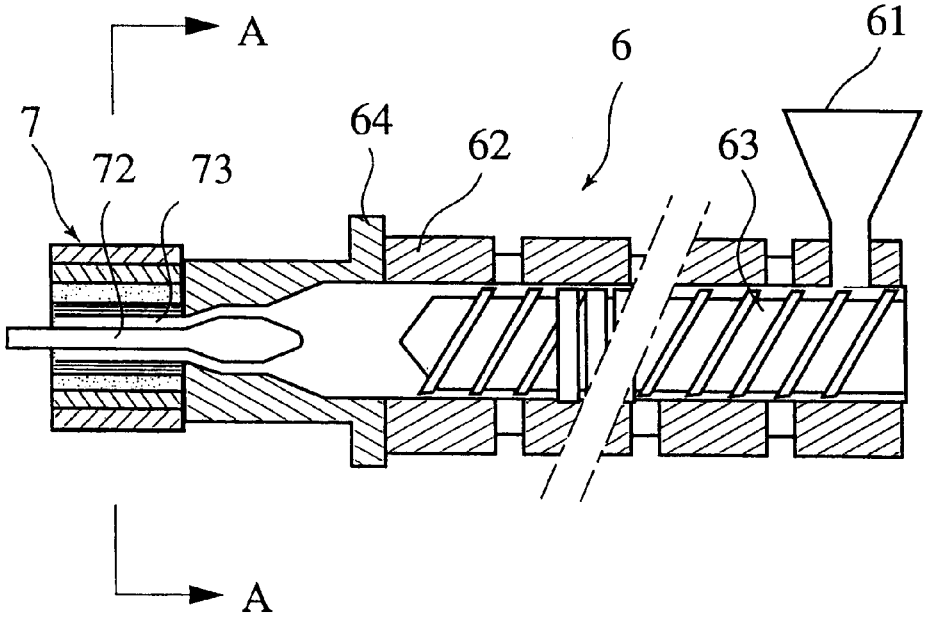
FIG. 1 is a longitudinal cross-sectional view showing a main portion of an extrusion-molding apparatus usable for producing the magnet roll of the present invention.
Figure 2:
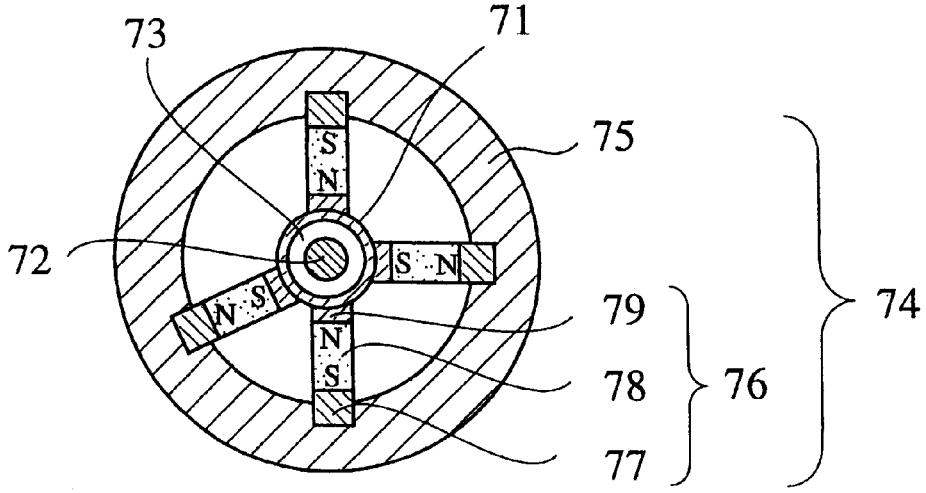
FIG. 2 is a cross-sectional view taken along the line A—A in FIG. 1.

FIGS. 1 and 2 show a structure of a molding apparatus. FIG. 1 is a longitudinal cross-sectional view showing a main portion of the molding apparatus, and FIG. 2 is a cross-sectional view taken along the line A—A in FIG. 1. A double-screw kneading extruder 6 comprises a barrel 62 divided into a plurality of parts, two screws 63 (only one is shown in the figure) disposed therein, and an adaptor 64 attached to a tip end of the barrel 62. A molding die 7 is connected to an exit of the adaptor 64. Further, the double-screw kneading extruder 6 has a hopper 61 at an upstream end thereof. The die 7 of the molding apparatus comprises a ring-shaped spacer 71, a mandrel 72 and a cylindrical molding space 73 formed therebetween. In addition, an outlet of the die is provided with a magnetic field-generating member 74 disposed around the ring-shaped spacer 71.

The magnetic field-generating member 74 comprises a plurality of magnet units 76 disposed inside a cylindrical yoke 75 made of a ferromagnetic material to surround the molding space 73. Each magnet unit 76 has a spacer 77 made of a ferromagnetic material, a permanent magnet 78 magnetized in a radial direction, and a magnetic pole piece 79 made of a ferromagnetic material.

With the above-described molding apparatus, the anisotropic bonded magnet can be obtained as follows. A starting material introduced into the barrel 62 through the hopper 61 is conveyed to the molding die 7 while being molten by heating at a temperature of 150–230° C. under shear stress by the rotation of a pair of screws 63, and passes through the molding space reduced to a predetermined cross section. The molded product extruded is made anisotropic around the outlet of the die, followed by cooling to solidification and cutting to a predetermined length($L/D \geqq 5$). The strength of a magnetic field applied for orienting the magnet powder is preferably within the range of 10 to 15 kOe. The resultant molded product is fixed to a shaft, and then magnetized in the direction in which anisotropy is given to provide a magnet roll shown in FIG. 3. The bonded magnet for the magnet roll of the present invention can also be manufactured by injection molding.

Figure 3A:
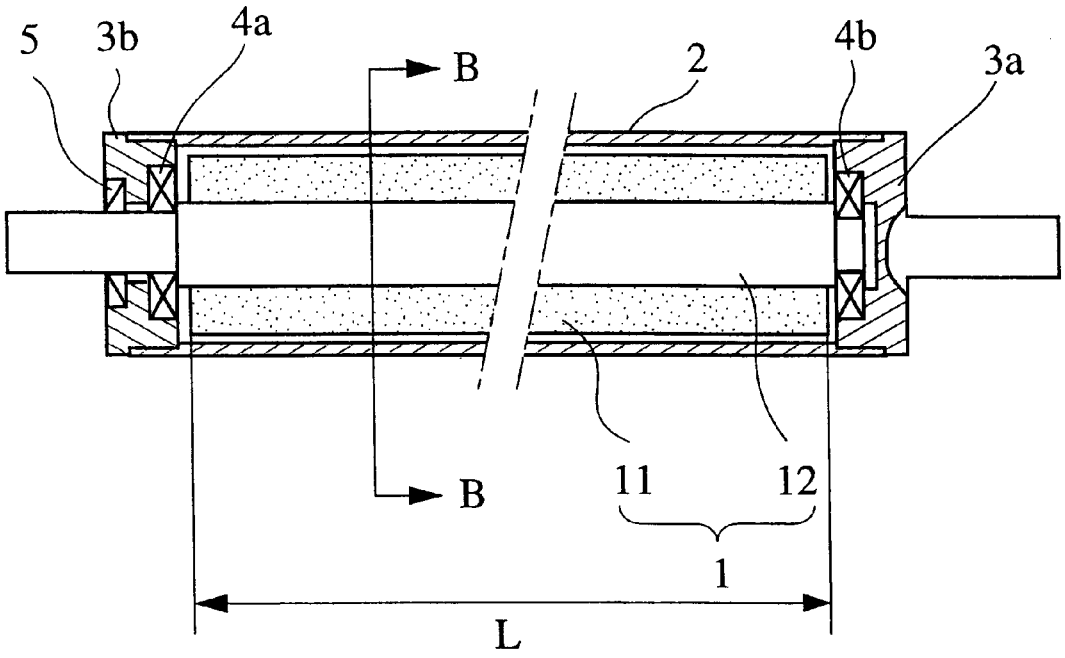
FIG. 3(*a*) is a longitudinal cross-sectional view showing a magnet roll assembly comprising a cylindrical bonded magnet obtained by the present invention.
Figure 3B:
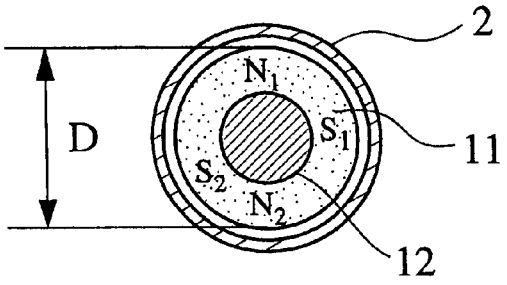
Figure 4:
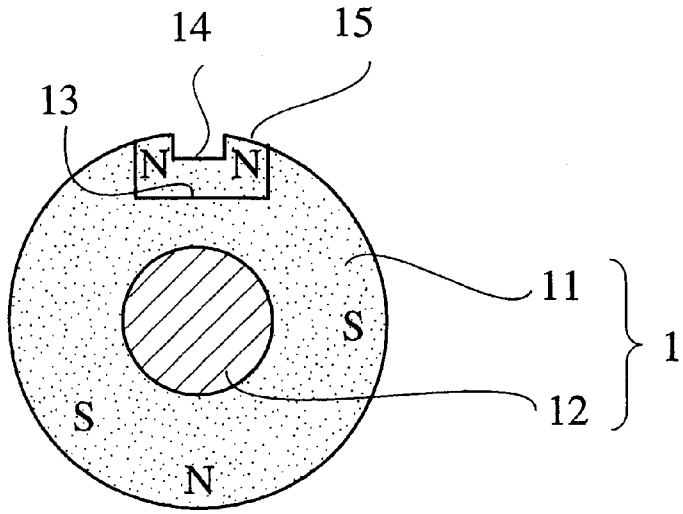
FIG. 4 is a transverse cross-sectional view showing a magnet roll according to another embodiment of the present invention.

The magnet roll of the present invention may have not only the structure shown in FIG. 3, but also the structure shown in FIG. 4. Specifically, an isotropic sintered ferrite magnet or a cylindrical permanent magnet 11 made of a bonded magnet molded without orientation is fixed to a shaft 12, and provided with a groove 13 in a developing magnetic pole portion thereof. A block-shaped bonded magnet piece 15 having a groove 14 extending in a longitudinal direction thereof may be fixed to the groove 13, followed by multi-pole magnetization.

Figure 5:
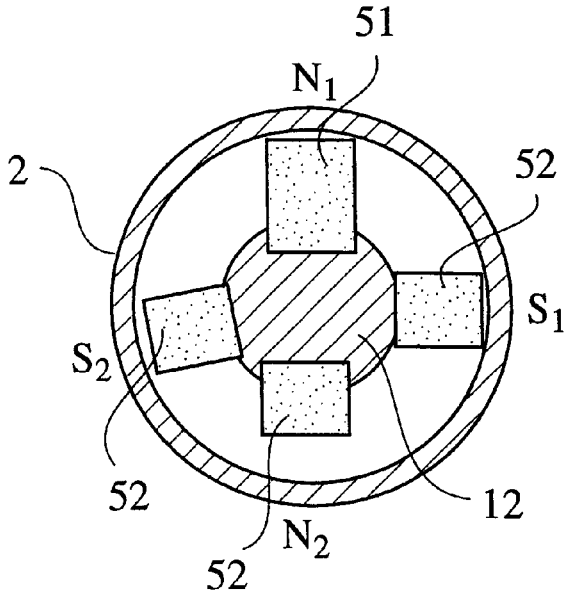
FIG. 5 is a transverse cross-sectional view showing a magnet roll according to a further embodiment of the present invention.

The magnet roll of the present invention may have a structure as shown in FIG. 5. Magnet pieces 51, 52, . . . are fixed to a plurality of longitudinal grooves formed on a shaft 12, such that a magnet piece 51 made of a bonded nitride-type rare earth magnet generating the largest magnetic force is placed at a position of the developing magnetic pole. The other magnet pieces 52, 52, . . . may be formed by either a bonded nitride-type rare earth magnet or a bonded ferrite magnet.

Figure 6:
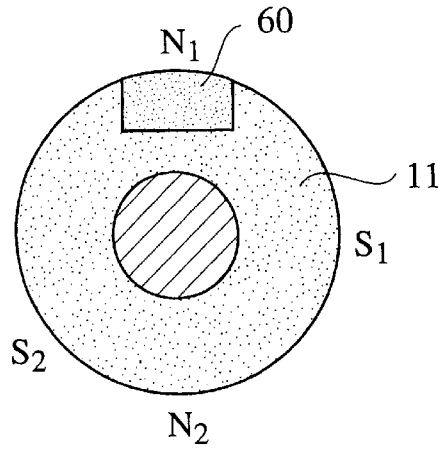
FIG. 6 is a transverse cross-sectional view showing a magnet roll according to a still further embodiment of the present invention.
Figure 7:
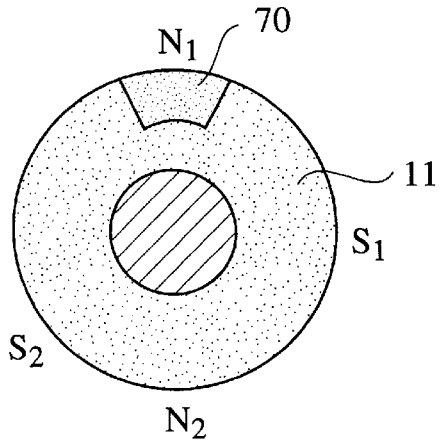
FIG. 7 is a transverse cross-sectional view showing a magnet roll according to a still further embodiment of the present invention.

The bonded magnet pieces fixed to the grooves may have any cross-sectional shape. For instance, bonded magnet pieces 60 and 70 each having a rectangular or sector cross section as shown in FIGS. 6 and 7, respectively, are fixed to grooves, worked in outer surfaces thereof, and then magnetized to have a plurality of magnetic poles. When the bonded magnet pieces are prepared in advance such that they have surfaces conforming to the outer surfaces of the cylindrical permanent magnets 11, the outer surfaces of the bonded magnet pieces need not be worked after assembling.

Figure 8:
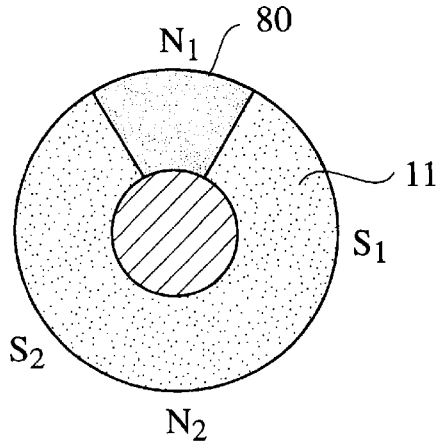
FIG. 8 is a transverse cross-sectional view showing a magnet roll according to a still further embodiment of the present invention.

The cylindrical permanent magnet 11 can be formed to have a C-shaped cross section to receive a bonded magnet piece 80 constituting a developing magnetic pole portion in its opening (FIG. 8). When a plurality of block-shaped magnet pieces each having a sector cross section are combined in the cylindrical permanent magnet 11 (FIG. 9), the above-described bonded magnet piece 90 is used at least in a developing magnetic pole portion.

Figure 11:
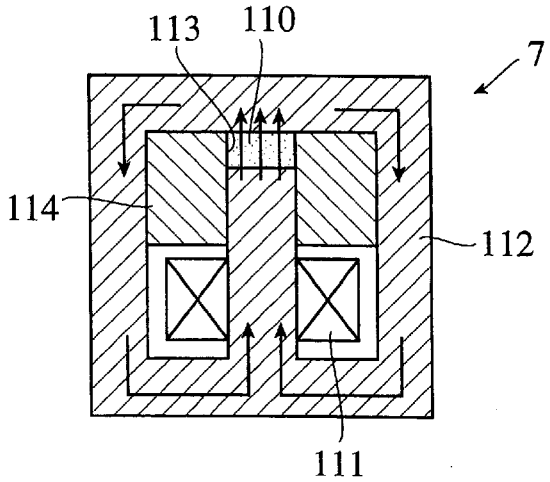
FIG. 11 is a cross-sectional view showing a die used for molding in a parallel magnetic field.
Figure 12:
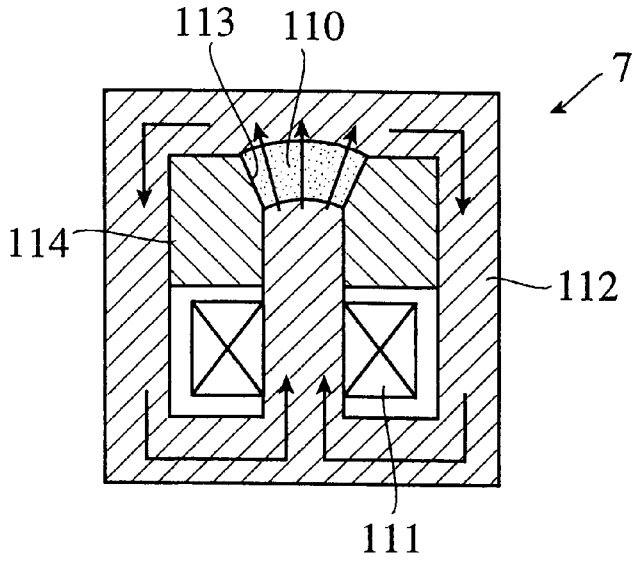
FIG. 12 is a cross-sectional view showing a die used for molding in a radial orientation magnetic field.

The bonded magnet pieces 15, 51, 60, 70, 80, 90 fitted into the cylindrical permanent magnets 11 as the developing magnetic pole portions as shown in FIGS. 4 to 9 can be formed, for instance, by extrusion molding or injection molding using molding dies shown in FIGS. 11 and 12. FIG. 11 is a cross-sectional view showing the molding die. Magnetic flux generated by a magnetic field-generating coil 111 passes through a yoke 112 to form a magnetic circuit. There is a molding space 113 in the course of the magnetic circuit, and a heat-kneaded mixture 110 of a resin and a magnet powder is extruded therethrough with a similar extruder (not shown) to that of FIG. 1. When extruded, the magnet powder is oriented by a parallel magnetic field indicated by arrows. The molding space 113 is defined by the yoke 112 and a non-magnetic member 114.

The molding die shown in FIG. 12 forms a magnetic circuit similar to that of FIG. 11, providing a radially oriented block-shaped magnet piece having a sector cross section.

The molding dies of FIGS. 11 and 12 can be used in injection molding with a molding space 113 in the same shape as that of a molded product.

The cylindrical permanent magnet 11 can be produced as an integral, radially oriented, bonded magnet. This magnet can have any magnetic pole arrangement or any magnetization pattern, and can be set in a magnetizing apparatus at any phase (any position in the peripheral direction). Further, a new magnetic pole arrangement or magnetization pattern can also be given by demagnetization and remagnetization. This is a great advantage over a polar anisotropic permanent magnet member whose magnetic pole arrangement or magnetization pattern is restricted by an orientation pattern, and which must be set in a magnetizing apparatus at a specific phase to the magnetizing apparatus.

Figure 13:
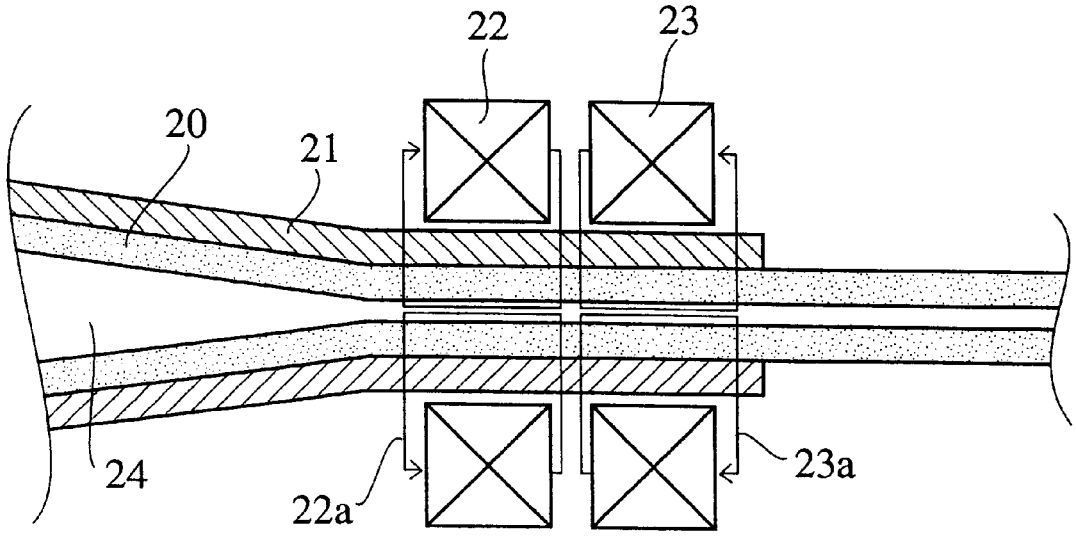
FIG. 13 is a cross-sectional view showing an extrusion die used for radially orienting a cylindrical magnet.

To form the integral, radially oriented, cylindrical permanent magnet, extrusion molding shown in FIG. 13, for instance, can be used. An apparatus therefor comprises magnetic field-generating coils 22, 23 attached to a molding die 21 at a tip end of an extrusion molding apparatus, the coils 22, 23 forming magnetic circuits 22*a*, 23*a*, through which a material 20 is subjected to radially orienting magnetic field. With a mandrel 24 formed of a magnetic material, magnetic circuits 22*a*, 23*a* are easily formed.

The present invention will be described in detail referring to EXAMPLES below, without intention of restricting the scope of the present invention thereto.

EXAMPLES 1–7

Sm, Fe and C each having a purity of 99.9% were mixed to provide compositions of matrix alloys shown in Table 1, and melted in a high-frequency furnace in an argon gas atmosphere to prepare matrix alloy ingots. In addition to this, quenched thin ribbons obtained by using a twin-roll strip casting machine equipped with two cooling copper rolls may be used for preparing the matrix alloys. Further, a SM—Fe—C alloy obtained by reduction diffusion of a rear earth oxide, an Fe alloy and Ca may also be used.

The resultant matrix alloy was pulverized to an average particle size of about 100 μm or less, subjected to a heat treatment at 400–500° C. for 1–10 hours in a nitrogen gas atmosphere for nitriding. Further, fine pulverization was carried out by a jet mill (a ball mill may be used) to an average particle size (dp) of 1–10 μm, to provide Sm—Fe—C—N alloy powder having a coercive force of 5 kOe or more. For the measurement of an average particle size dp of the alloy powder, a laser diffraction-type apparatus for measuring particle size distribution (HEROS & RODOS system) available from Sympatec was used. A mixed gas of $H_2$ and a nitrogen-containing gas such as $NH_3$ may be used for a nitriding treatment. It was confirmed by X-ray diffraction that the alloy powder had a crystal structure of $Th_2Zn_{17}$, $Th_2Ni_{17}$, or a mixture thereof Each magnet powder was mixed with a binder resin comprising chlorinated polyethylene to give a volume fraction of 70% to provide pellets for extrusion molding. The pellets were extrusion-molded at a molding temperature of 180° C. in a magnetic field of 10 kOe to a cylindrical shape of 18 mm in outer diameter and 8 mm in inner diameter, and then cut to a length of 300 mm. Then, the resultant cylindrical bonded magnet was fixed to a stainless steel shaft of 8 mm in outer diameter. The cylindrical bonded magnet was symmetrically magnetized to have 8 magnetic poles, and then assembled in an aluminum alloy sleeve of 20 mm in outer diameter.

The measurements of a surface magnetic flux density on the sleeve revealed that the surface magnetic flux density at any magnetic pole was as strong as about 2100 G or more and uniform. In the case of an isotropic sintered ferrite magnet of the same size, the surface magnetic flux density on a sleeve was about 750 G. When an anisotropic bonded ferrite magnet extrusion-molded by an 8-pole magnetic field orientation die was used, the surface magnetic flux density was about 900 G.

A corrosion resistance test was carried out by placing 10 magnet rolls for each composition at a temperature of 60° C. and a relative humidity of 95% for 500 hours, and observing under an optical microscope whether or not rust was generated. The corrosion resistance was evaluated by the formula: [number of rusted magnet rolls/10]×100 (%).

The uniformity of surface magnetic flux density is closely related to whether molding is easy or difficult. In the case of good moldability, magnet powder is distributed uniformly, resulting in a uniform surface magnetic flux density distribution. On the other hand, in the case of poor moldability, magnet powder is not distributed uniformly, resulting in a non-uniform surface magnetic flux density distribution. Each magnet roll was measured with respect to a surface magnetic flux density distribution of magnetic poles on a sleeve at 10 portions in a longitudinal direction, and the uniformity of surface magnetic flux density was evaluated by the formula: [(maximum surface magnetic flux density−minimum surface magnetic flux density)/average surface magnetic flux density]×100 (%).

Comparative Examples 1–5

Nitride rare earth magnet powder was produced under the same conditions as in EXAMPLES 1–7 except for adapting compositions containing too large amounts of C (COMPARATIVE EXAMPLES 1 and 2) and compositions containing no N (COMPARATIVE EXAMPLES 3–5). Using the nitride rare earth magnet powder, bonded magnets were produced, and evaluated in the same manner as in EXAMPLES. The results are shown in Table 1.

TABLE 1

| No. | Composition (atomic %) of Nitride Rare Earth Magnet Powder | dp (μm) | $B_{surf}$[1] (G) | Corrosion Resistance (%) | Uniformity (%) | C (at. %) |
|---|---|---|---|---|---|---|
| EX. 1 | $Sm_{9.1}Fe_{bal.}N_{13.5}$ | 2.2 | 2100 | 0 | 0.2 | 0.01 |
| EX. 2 | $Sm_{9.2}Fe_{bal.}N_{13.3}$ | 2.3 | 2070 | 0 | 0.1 | 0.03 |
| EX. 3 | $Sm_{9.3}Fe_{bal.}N_{13.8}$ | 2.4 | 2030 | 0 | 0.3 | 0.05 |
| EX. 4 | $Sm_{9.2}Fe_{bal.}N_{13.4}$ | 2.2 | 2010 | 0 | 0.2 | 0.07 |
| EX. 5 | $Sm_{9.1}Fe_{bal.}N_{13.1}$ | 2.5 | 1970 | 0 | 0.1 | 1.0 |
| EX. 6 | $Sm_{9.2}Fe_{bal.}N_{13.0}$ | 2.3 | 1930 | 0 | 0.2 | 3.0 |
| EX. 7 | $Sm_{9.2}Fe_{bal.}N_{13.2}$ | 2.3 | 1910 | 0 | 0.2 | 5.0 |
| COM. EX. 1 | $Sm_{9.1}Fe_{bal.}N_{13.1}$ | 2.2 | 980 | 20 | 0.2 | 6.0 |
| COM. EX. 2 | $Sm_{9.2}Fe_{bal.}N_{13.0}$ | 2.5 | 820 | 90 | 0.1 | 10.0 |
| COM. EX. 3 | $Sm_{9.2}Fe_{bal.}$ | 2.3 | 800 | 100 | 3.5 | 0.01 |
| COM. EX. 4 | $Sm_{9.2}Fe_{bal.}$ | 2.3 | 720 | 100 | 5.3 | 5.0 |
| COM. EX. 5 | $Sm_{9.2}Fe_{bal.}$ | 2.1 | 650 | 100 | 6.3 | 12.0 |

Note
[1]Surface magnetic flux density.

Table 1 shows that the bonded magnets of COMPARATIVE EXAMPLES 1 and 2 containing too large amounts of C are low in both surface magnetic flux density and corrosion resistance. It was also found that the bonded magnets of COMPARATIVE EXAMPLES 3–5 containing only C without N were low in all surface magnetic flux density, corrosion resistance and uniformity.

EXAMPLES 8–10

Comparative Examples 6, 7

Magnet powder having an average particle size of 2–9 μm (EXAMPLES 8–10), magnet powder having a small average particle size (COMPARATIVE EXAMPLE 6) and magnet powder having a large average particle size (COMPARATIVE EXAMPLE 7) were studied. Nitride magnet powder was produced under the same conditions as in EXAMPLES 1–7, and each magnet powder was formed into a magnet roll to conduct the same evaluation as in the EXAMPLES. The results are shown in Table 2.

TABLE 2

| No. | Composition (atomic %) of Nitride Rare Earth Magnet Powder | dp (μm) | $B_{surf}$(1) (G) | Corrosion Resistance (%) | Uniformity (%) | C (atomic %) |
|---|---|---|---|---|---|---|
| EX. 8 | $Sm_{9.1}Fe_{bal}N_{13.5}$ | 2 | 2100 | 0 | 0.2 | 0.05 |
| EX. 9 | $Sm_{9.2}Fe_{bal}N_{13.3}$ | 5 | 2070 | 0 | 0.4 | 0.05 |
| EX. 10 | $Sm_{9.3}Fe_{bal}N_{13.8}$ | 9 | 2030 | 0 | 0.5 | 0.05 |
| COM. EX. 6 | $Sm_{9.2}Fe_{bal}N_{13.0}$ | 0.8 | 720 | 0 | 3.1 | 0.05 |
| COM. EX. 7 | $Sm_{9.2}Fe_{bal}N_{13.0}$ | 15 | 650 | 0 | 4.3 | 0.05 |

Note
(1)Surface magnetic flux density.

Table 2 indicates that a high surface magnetic flux density and uniformity are obtained in the case of rare earth nitride magnet powder having an average particle size of 2–9 μm. When the average particle size is small (COMPARATIVE EXAMPLE 6) or large (COMPARATIVE EXAMPLE 7), the surface magnetic flux density is low with poor uniformity.

EXAMPLES 11–15

Magnet rolls were produced and their characteristics were examined under the same conditions as in EXAMPLES 1–7, except for mixing Sm, Fe and M each having a purity of 99.9% to provide compositions of matrix alloys shown in Table 4, and melting the resultant mixtures in a high-frequency furnace in an argon gas atmosphere to prepare matrix alloy ingots. The heat resistance is expressed by the ratio of a decrease in surface magnetic flux density after each magnet roll was placed in an environment at 80° C. for 50 hours.

Comparative Examples 8, 9

Magnet rolls were produced and evaluated in the same manner as in EXAMPLES 1–7 except for changing the compositions of rare earth nitride magnets.

TABLE 3

| No. | Composition (atomic %) of Nitride Rare Earth Magnet Powder | dp (μm) | $B_{surf}$(1) (G) | Corrosion Resistance (%) | Uniformity (%) | Heat Resistance (%) | C (at. %) |
|---|---|---|---|---|---|---|---|
| EX. 11 | $Sm_{9.1}Fe_{bal}Ti_{2.5}N_{13.5}$ | 3.1 | 2050 | 0 | 0.2 | 1.2 | 0.01 |
| EX. 12 | $Sm_{9.2}Fe_{bal}Ti_{1.0}N_{13.2}$ | 3.5 | 1900 | 0 | 0.2 | 1.4 | 0.01 |
| EX. 13 | $Sm_{9.2}Fe_{bal}Ti_{30}N_{13.2}$ | 3.5 | 1900 | 0 | 0.2 | 1.4 | 0.01 |
| EX. 14 | $Sm_{9.2}Fe_{bal}Ti_{2.5}N_{13.2}$ | 3.5 | 1900 | 0 | 0.2 | 1.4 | 5.0 |
| EX. 15 | $Sm_{9.1}Fe_{bal}Mn_{2.5}N_{13.6}$ | 2.3 | 1940 | 0 | 0.2 | 1.2 | — |
| COM. EX. 8 | $Sm_{9.2}Fe_{bal}Ti_{0.5}N_{13.2}$ | 3.5 | 780 | 0 | 0.3 | 7.4 | 0.01 |
| COM. EX. 9 | $Sm_{9.2}Fe_{bal}Ti_{3.5}N_{13.2}$ | 3.5 | 540 | 0 | 0.2 | 1.4 | 5.0 |

Note
(1)Surface magnetic flux density.

Table 3 shows that when the rare earth nitride magnet powder contains a main ingredient composition of $R_\alpha T_{100-(\alpha+\beta+\delta)}M_\beta N_\delta$ by atomic %, wherein R is at least one rare earth element including Y, Sm being indispensable, T is Fe or Fe and Co, M is at least one element selected from the group consisting of Al, Ti, V, Cr, Mn, Cu, Ga, Zr, Nb, Mo, Hf, Ta and W, Ti being indispensable, and α, β and δ satisfy $5 \leqq \alpha \leqq 18$, $1 \leqq \beta \leqq 30$ and $4 \leqq \delta \leqq 30$; O and H, inevitable impurities; and C suppressed to 5 or less atomic % of the magnet powder, the magnet rolls high in surface magnetic flux density and excellent in corrosion resistance and heat resistance are obtained.

EXAMPLE 16

Figure 10:
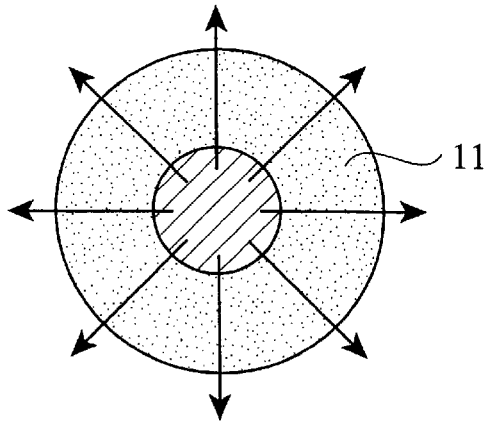
FIG. 10 is a transverse cross-sectional view showing a magnet roll according to a still further embodiment of the present invention.

A magnet roll was produced and evaluated under the same conditions as in EXAMPLE 1, except for forming a radially oriented cylindrical permanent magnet 11 of FIG. 10 with an extrusion molding apparatus of FIG. 13. Evaluation results similar to those of EXAMPLE 1 were obtained.

EXAMPLE 17

Figure 9:
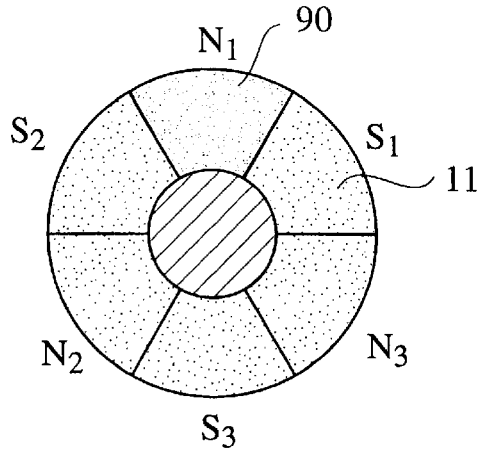
FIG. 9 is a transverse cross-sectional view showing a magnet roll according to a still further embodiment of the present invention.

Block magnets each having a sector-shaped cross section were bonded to each other to provide a magnetic roll as shown in FIG. 9. Each block magnet was radially oriented during injection molding using a molding die of FIG. 12.

Developing Magnetic Pole

The same R—T—N magnet powder as in EXAMPLE 1 was mixed with a binder resin of chlorinated polyethylene in a volume fraction of 70% to prepare pellets. Using the pellets thus prepared, a block magnet having a sector cross section with a center angle of 90° was injection-molded in a magnetic field of 10 kOe at a temperature of 180° C.

Other Magnetic Pole

Anisotropic ferrite magnet powder represented by $SrO.6Fe_2O_3$ and having an average particle size of 1.2 μm was obtained. This ferrite magnet powder was mixed with a binder resin comprising an ethylene-ethyl acrylate (EEA) resin in a weight fraction of 92% to prepare pellets. Using the pellets thus prepared, a block magnet having a sector cross section with a center angle of 90° was injection-molded in a magnetic field of 10 kOe at a temperature of 180° C.

Production and Evaluation of Magnet Roll

Using one block magnet containing the R—T—N magnet powder and three block magnets containing the ferrite magnet powder, a magnet roll having the same dimension as that of EXAMPLE 1 was produced, and the developing magnetic pole was evaluated. Evaluation results similar to those of EXAMPLE 1 were obtained.

EXAMPLE 18

Block magnets each having a sector cross section were bonded to each other to provide a magnetic roll as shown in FIG. 9. Each block magnet was radially oriented during extrusion molding using a molding die of FIG. 12.

Developing Magnetic Pole

A magnet powder mixture of 60 parts by weight of the same R—T—N magnet powder as in EXAMPLE 1 and 40 parts by weight of anisotropic ferrite magnet powder represented by $SrO.6Fe_2O_3$ and having an average particle size of 1.2 μm were blended with a binder resin of chlorinated polyethylene in a volume fraction of 70% to prepare pellets. Using the pellets thus prepared, a block magnet having a sector cross section with a center angle of 90° was extrusion-molded in a magnetic field of 10 kOe at a temperature of 180° C.

Other Magnetic Pole

Anisotropic ferrite magnet powder represented by $SrO.6Fe_2O_3$ and having an average particle size of 1.2 μm was prepared. This ferrite magnet powder was mixed with a binder resin comprising an EEA resin in a weight fraction of 92% to prepare pellets. Using the pellets thus prepared, a block magnet having a sector cross section with a center angle of 90° was extrusion-molded in a magnetic field of 10 kOe at a temperature of 180° C.

Production and Evaluation of Magnet Roll

Using one block magnet containing the mixed magnet powder and three block magnets containing the ferrite magnet powder, a magnet roll having the same dimension as that of EXAMPLE 1 was produced to evaluate the developing magnetic pole. Evaluation results similar to those of EXAMPLE 1 were obtained, except that the surface magnetic flux density was decreased by about 40%.

EXAMPLE 19

A magnetic roll was produced by a cylindrical magnet having a C-shaped cross section and a block magnet having a sector cross section as shown in FIG. 8. The block magnet having a sector cross section was radially oriented during injection molding using a molding die of FIG. 12.

Developing Magnetic Pole

A magnet powder mixture of 60 parts by weight of the same R—T—N magnet powder as in EXAMPLE 1 and 40 parts by weight of anisotropic ferrite magnet powder represented by $SrO.6Fe_2O_3$ and having an average particle size of 1.2 μm were blended with a binder resin of chlorinated polyethylene in a volume fraction of 70% to prepare pellets. Using the pellets thus prepared, a block magnet having a sector cross section with a center angle of 90° was injection-molded in a magnetic field of 10 kOe at a temperature of 180° C.

Other Magnetic Pole

Isotropic ferrite magnet powder represented by $SrO.6Fe_2O_3$ was prepared. This ferrite magnet powder was mixed with a binder resin of an EEA resin in a weight fraction of 92% to prepare pellets. Using the pellets thus prepared, a cylindrical magnet having a C-shaped cross section with a center angle of 270° was injection-molded at a temperature of 180° C.

Production and Evaluation of Magnet Roll

Using the above two magnets, a magnet roll having the same dimension as that of EXAMPLE 1 was produced to evaluate the developing magnetic pole. Evaluation results were the same as in EXAMPLE 1, except that the surface magnetic flux density was decreased by about 40%.

As described above in detail, because the present invention uses the anisotropic bonded magnet obtained by molding the starting material mixture in which the R—T—N magnet powder is dispersed in the binder resin, an easy-to-use magnet roll high in magnetic force and stability is obtained.

In the present invention, even when the R—T—N magnet powder is used alone or mixed with the ferrite magnet powder, a surface flux magnetic density of 2000 G or more is obtained on the sleeve. Accordingly, the magnetic roll having a high magnetic force with a reduced content of the expensive R—T—N magnet powder is obtained.

What is claimed is:

1. A magnet roll having a plurality of magnetic poles on a surface, at least one magnetic pole portion being composed of an anisotropic bonded magnet comprising magnet powder and a binder resin, said anisotropic bonded magnet containing an R—T—N magnet powder, wherein R is at least one rare earth element including Y, Sm being indispensable, T is Fe or Fe and Co, and O and H, inevitable impurities, may be contained, and said binder resin, a volume ratio of said binder resin being 20–70%.

2. The magnet roll according to claim 1, wherein said anisotropic bonded magnet has a maximum energy product $(BH)_{max}$ of 10 MGOe or more and a residual magnetic flux density Br of 2800 G or more.

3. The magnet roll according to claim 1, wherein said magnet powder comprises main ingredients having a composition represented by $R_\alpha T_{100-(\alpha+\delta)}N_\delta$ by atomic %, wherein R is at least one rare earth element including Y, Sm being indispensable, T is Fe or Fe and Co, and α and δ satisfy $5 \leqq \alpha \leqq 18$ and $4 \leqq \delta \leqq 30$, respectively; O and H, inevitable impurities; and C, inevitable impurity, reduced to 5 or less atomic %, outer % based on 100 atomic % of said magnet powder, and has a magnetism-generating phase which is substantially a hard magnetic phase composed of a rhombohedral crystal having a $Th_2Zn_{17}$ structure and/or a hexagonal crystal having a $Th_2Ni_{17}$ structure.

4. The magnet roll according to claim 1, wherein said magnet powder comprises main ingredients having a composition represented by $R_\alpha T_{100-(\alpha+\beta+\delta)}M_\beta N_\delta$ by atomic %, wherein R is at least one rare earth element including Y, Sm being indispensable, T is Fe or Fe and Co, M is at least one element selected from the group consisting of Al, Ti, V, Cr, Mn, Cu, Ga, Zr, Nb, Mo, Hf, Ta and W, Ti being indispensable, and α, β and δ satisfy $5 \leqq \alpha \leqq 18$, $1 \leqq \beta \leqq 30$ and $4 \leqq \delta \leqq 30$, respectively; O and H, inevitable impurities; and C, inevitable impurity, reduced to or less atomic %, outer % based on 100 atomic % of said magnet powder, and has a magnetism-generating phase which is substantially a hard magnetic phase composed of a rhombohedral crystal having a $Th_2Zn_{17}$ structure and/or a hexagonal crystal having a $Th_2Ni_{17}$ structure.

5. The magnet roll according to claim 1, wherein said anisotropic bonded magnet contains ferrite magnet powder.

6. The magnet roll according to claim 3 or 4, wherein said magnet powder has an average particle size of 1–10 μm.

* * * * *